US008777047B2

(12) United States Patent
Blomberg

(10) Patent No.: US 8,777,047 B2
(45) Date of Patent: Jul. 15, 2014

(54) CONTAINERS

(71) Applicant: Meissner Filtration Products, Inc., Camarillo, CA (US)

(72) Inventor: Max Blomberg, Camarillo, CA (US)

(73) Assignee: Meissner Filtration Products, Inc., Camarillo, CA (US)

( * ) Notice: Subject to any disclaimer, the term of this patent is extended or adjusted under 35 U.S.C. 154(b) by 0 days.

(21) Appl. No.: 14/032,057

(22) Filed: Sep. 19, 2013

(65) Prior Publication Data

US 2014/0014712 A1 Jan. 16, 2014

Related U.S. Application Data

(62) Division of application No. 13/296,009, filed on Nov. 14, 2011, now Pat. No. 8,573,435, which is a division of application No. 12/383,399, filed on Mar. 23, 2009, now Pat. No. 8,079,492.

(60) Provisional application No. 61/070,906, filed on Mar. 25, 2008.

(51) Int. Cl.
*B65D 6/00* (2006.01)

(52) U.S. Cl.
USPC ..... 220/678; 220/23.83; 220/62.22; 220/495.06; 383/9; 383/96; 383/104; 383/109; 383/120; 229/108; 493/56; 493/133; 493/162; 493/189

(58) Field of Classification Search
USPC ..... 220/678, 23.83, 62.22, 495.06; 229/108; 493/56, 133, 162, 189; 383/9, 383/96, 104, 109, 120
See application file for complete search history.

(56) References Cited

U.S. PATENT DOCUMENTS

| | | | | |
|---|---|---|---|---|
| 4,968,624 | A | 11/1990 | Bacehowski et al. | |
| 5,988,422 | A | 11/1999 | Vallot | |
| 6,139,482 | A | 10/2000 | Lafleur | |
| 6,332,711 | B1 | 12/2001 | Inuzuka et al. | |
| 6,893,696 | B2 | 5/2005 | Hansen et al. | |
| 7,523,918 | B2 | 4/2009 | Matkovich et al. | |
| 8,079,492 | B2 * | 12/2011 | Blomberg | 220/678 |
| 2002/0131654 | A1 | 9/2002 | Smith et al. | |
| 2009/0236338 | A1 | 9/2009 | Elton et al. | |
| 2009/0236344 | A1 | 9/2009 | McRobbie et al. | |
| 2013/0048703 | A1 * | 2/2013 | Fuchs | 229/117.09 |

FOREIGN PATENT DOCUMENTS

| | | |
|---|---|---|
| WO | WO 84/04287 | 11/1984 |
| WO | WO 98/54065 | 12/1998 |
| WO | WO 00/04131 | 1/2000 |
| WO | WO 2006/050105 A1 | 5/2006 |

* cited by examiner

*Primary Examiner* — Fenn Mathew
*Assistant Examiner* — Elizabeth Volz
(74) *Attorney, Agent, or Firm* — Christie, Parker & Hale, LLP

(57) ABSTRACT

A polyhedron disposable container formed from flexible weldable plastic film is provided. The container has opposite ends and an opening that accommodates a port at the center of at least one of such ends. The container also has multiple sides and an opening on at least one such side located midway between the edges of such side.

16 Claims, 9 Drawing Sheets

CONTAINERS

CROSS-REFERENCE TO RELATED APPLICATION(S)

This application is a divisional of U.S. application Ser. No. 13/296,009, filed Nov. 14, 2011, which is a divisional of U.S. application Ser. No. 12/383,399, filed Mar. 23, 2009, issued on Dec. 20, 2011 as U.S. Pat. No. 8,079,492, which claims priority to and the benefit of U.S. Provisional Patent Application No. 61/070,906, filed Mar. 25, 2008, the entire contents of which are incorporated herein by reference.

TECHNICAL FIELD

The present invention relates to the field of disposable containers made from flexible single or multilayer weldable plastic film. Some embodiments relate to improved disposable containers, manufacture thereof and use thereof for collection, dispensing, storing, processing, mixing of pharmaceutical raw materials and pharmaceutical products, and cell culture.

BACKGROUND OF THE INVENTION

The present invention involves polyhedron-shaped disposable containers made of flexible weldable plastic film designed to fit rigid wall outer containers such as quadrilateral-based or cylindrically shaped bins, drums, tanks, totes, hoppers that can have elongated polygonal-shaped projections on their top, bottom or side views as to accommodate their use in specific pharmaceutical liquid handling and processing applications.

A degree or approximation of fit of a disposable container towards an inner contour of a polyhedron shaped bin, drum, tank, tote, hopper that can have elongated polygonal-shaped projections on its top, bottom or sides views, is dependent on the flexural properties of the plastic film used to make such disposable container. It further depends on the shape, surface area and circumference of the rigid wall outer container. It also depends on the chosen number and shapes of the polygon faces that together form the polyhedral surface of the disposable container designed to fit the rigid wall outer container.

Gusseted disposable containers are typically used to fit square and rectangular shaped bins or tanks and sometimes to fit cylindrically shaped drums or tanks. A gusset is formed when an integrally connected film ply edge is folded inward to form folds along that edge. Various gusseted film plies can then be sealed to other film plies to form individual gusseted disposable containers. Upon filling of the gusseted disposable container, the gusset unfolds to reveal, as the case may be, side, top and bottom faces of said disposable container having the same measure as the width of the folds.

A common processing problem encountered in the manufacturing of gusseted disposable containers is ensuring that the depth and alignment of gusset folds, with respect to each other and all film plies is maintained after the gusset has been introduced into the film ply until the sealing of the film ply into individual disposable containers. The misalignment of gusseted film plies can lead to stress points at its weld edges. These stress points can than lead to fatigue cracking of the disposable container during routine use resulting in leakage points.

Another common processing problem encountered with disposable containers that are manufactured using gusseted film plies is the formation of leakage points along the edge welds at the innermost point of the inward fold of the gusset of the disposable container due to incomplete heat sealing.

A common limitation encountered with disposable containers that are manufactured using gusseted film plies is that usually no weldments are possible at or near the center or centroid position of the top, bottom or side faces, as the case may be, of the disposable container due to interference of edge welds in the film plies.

Accordingly, there exists a need for a ungusseted disposable container and a manufacturing process for said disposable containers without the use of gusseted film plies to minimize leakage points along its edge welds. In addition there exists a need for disposable containers which can have weldments at or near the center or centroid position of their top, bottom or side face, as the case may be, to facilitate their use as disposable mixers and disposable bioreactors.

SUMMARY OF THE INVENTION

In an exemplary embodiment, a method of forming a disposable container from weldable plastic film is provided. The method includes cutting a first pattern from a weldable plastic film, the first pattern including a central first polygonal section and a first quadrilateral section extending from each side of the first polygonal section such that each first side of the first polygonal section is also a first side of one of the first quadrilateral sections and defines a folding line. Moreover, each first quadrilateral section has a second side opposite its first side and a third side opposite a fourth side, where the third and fourth sides extend between the first and second sides. Furthermore, each first quadrilateral section has a width measured along its folding line and a height as measured transverse to its folding line between its first and second sides, wherein each first quadrilateral section has a height that is different than a height of its adjacent first quadrilateral section. The method also requires cutting a second pattern from a weldable plastic film, the second pattern including a central second polygonal section and a second quadrilateral section extending from each side of the second polygonal section such that each side of the second polygonal section is also a first side of one of the second quadrilateral sections and defines a folding line. Moreover, each second quadrilateral section has a second side opposite its first side and a third side opposite a fourth side, where the third and fourth sides extend between the first and second sides. Furthermore, each second quadrilateral section has a width measured along its folding line and a height as measured transverse to its folding line between its first and second sides, where each second quadrilateral section has a height that is different than a height of its adjacent second quadrilateral section, and wherein the second pattern has the same number of quadrilateral sections as the first pattern. The method also requires folding each first quadrilateral section about its folding line, folding each second quadrilateral section about its folding line, aligning the second side of each second quadrilateral section with a second side of each first quadrilateral section, defining a polygonal box where the first and second polygonal sections define opposite ends of the box and each pair of aligned quadrilateral sections defines a side of the box extending between the first and second polygonal sections, such that each side of the box has a first edge opposite a second edge, each first edge is defined by the third sides of each pair of aligned quadrilateral sections and each second edge is defined by the fourth sides of each pair of aligned quadrilateral sections. The method further requires welding each second side of each second quadrilateral to its aligned second side of each first quadrilateral section, and welding the first edge of each side to the second edge of an adjacent side. In another exemplary embodiment, the method further includes forming a first opening through a center of the first polygonal section. In yet a further exemplary embodiment, the method also includes welding a first plastic member to the first opening. In yet another exemplary embodiment, the method also includes forming a second opening through the center of the second polygonal section. In yet a further exemplary embodiment, the method also includes forming a third opening through at least one of the quadrilateral sections midway between the third and fourth sides of the quadrilateral sections. In another exemplary embodiment the method further includes welding a first plastic member to the first opening, welding a second plastic member to the second opening, and welding as third plastic member to the third opening.

In another exemplary embodiment, a method of forming a disposable container from weldable plastic film is provided. The method requires cutting a first pattern from a weldable plastic film, the first pattern including a central first polygonal section and a first quadrilateral section extending from each side of the first polygonal section such that each first side of the first polygonal section is also a first side of one of the first quadrilateral sections and defines a folding line. The method also requires that each first quadrilateral section has a second side opposite its first side and a third side opposite a fourth side, where the third and fourth sides extend between the first and second sides, such that each first quadrilateral section has a width measured along its folding line and a height as measured transverse to its folding line between its first and second sides, and such that each first quadrilateral section has a height that is different than a height of its adjacent first quadrilateral section. Moreover the method requires cutting a second pattern from a weldable plastic film, the second pattern including a central second polygonal section, a trapezoidal section extending from each side of the second polygonal section, wherein each side of the second polygonal section is also a first side of one of the trapezoidal sections and defines a first folding line, wherein each trapezoidal section has a second side opposite its first side and a third side opposite a fourth side, where the third and fourth sides extend between the first and second sides and are not parallel to each other. The method also requires a second quadrilateral section extending from each second side of each trapezoidal section, wherein each second side of a trapezoidal section defines a second folding line and a first side of a quadrilateral section, wherein each second quadrilateral section comprises a second side opposite its first side and has a width measured along its second folding line and a height as measured transverse to its second folding line between its first and second sides, wherein each second quadrilateral section has a height that is different from a height of its adjacent second quadrilateral section, and wherein the second pattern has the same number of quadrilateral sections as the first pattern. The method further requires folding each first quadrilateral about its folding line, folding each trapezoidal section about its first folding line, folding each second quadrilateral section about its second folding line, whereby the third side of each trapezoidal section is aligned with the fourth side of an adjacent trapezoidal section. Moreover the claim requires aligning the second side of each second quadrilateral section with a second side of each first quadrilateral section, defining a polygonal box wherein the first and second polygonal sections define opposite ends of the box and each pair of aligned quadrilateral sections along with a corresponding trapezoidal section defines a side of the box extending between the first and second polygonal sections, wherein each polygonal box side has a first edge opposite a second edge, wherein each first edge is defined by the third sides of each pair of aligned first and second quadrilateral sections and the third side of a corresponding trapezoidal section and wherein each second edge is defined by the fourth sides of each pair of aligned first and second quadrilateral sections and the fourth side of each corresponding trapezoidal section. The claim also requires welding the first edge of each side to the second edge of an adjacent side. In a further exemplary embodiment the method further requires forming a first opening through a center of the first polygonal section. In yet another exemplary embodiment, the method also requires welding a first plastic member to the first opening. In yet a further exemplary embodiment, the method further requires forming a second opening through the center of the second polygonal section. In another exemplary embodiment, the method also requires forming a third opening through at least one of the quadrilateral sections midway between the third and fourth sides of the quadrilateral sections. In yet another exemplary embodiment, the method further requires welding a first plastic member to the first opening, welding a second plastic member to the second opening, and welding as third plastic member to the third opening.

In another exemplary embodiment, a polyhedron disposable container formed from flexible weldable plastic film is provided. The container includes a polygonal first end including a plurality of edges, a polygonal second end opposite the first end including a plurality edges, wherein the polygonal second end has the same number of edges as the polygonal first end, a plurality of sides extending between the polygonal first and second ends, wherein the plurality of sides are equal in number to the number of edges of each of the first and second polygonal ends, wherein each of the plurality of sides extend between an edge of the polygonal first and an edge of the polygonal second end, whereby the plurality of sides define the sides of the polyhedron container and the first and second polygonal ends define opposite ends of the container, wherein each side is welded on opposite edges thereof to two adjacent sides along a first weld line and a second weld line, respectively, wherein each side comprises a third weld line extending between the first weld line and the second weld line, an opening formed though a center of the first polygonal end, and an opening formed on at least one of the sides at a location midway between the first and second weld lines of the side. In another exemplary embodiment, the claim requires that the third weld line of each side is not aligned with the third weld line of an adjacent side. In yet another exemplary embodiment, the container also includes formed through the center of the second polygonal end. In yet a further exemplary embodiment, the container further includes a port welded to each opening.

In yet a further exemplary embodiment, a polyhedron disposable container formed from flexible weldable plastic film is provided. The container includes a polygonal first end including a plurality of edges, a polygonal second end opposite the first end including a plurality edges, wherein the polygonal second end has the same number of edges as the polygonal first end, a plurality of generally trapezoidal first sides, wherein a trapezoidal first side extends from an edge of the polygonal second end, wherein an edge of the polygonal second end defines a first edge of a trapezoidal first side, wherein each trapezoidal first side comprises a second edge opposite the first edge, the second edge being longer than the first edge, wherein each trapezoidal first side has a third edge extending between the first and second edges and a fourth edge extending between the first and second edges, wherein each trapezoidal first side third edge is welded to an adjacent trapezoidal first side fourth edge along a first weld line. The container also includes a plurality of second sides which are equal in number to the number of edges in each of the first and second polygonal ends, wherein each of the plurality of second sides extends between an edge of the polygonal first end and a second edge of a trapezoidal first side, whereby the plurality of second sides define the sides of the polyhedron container, wherein the trapezoidal first sides define a projection extending from such container sides, and the first and second polygonal ends define opposite ends of the container, wherein each side is welded on opposite edges thereof to two adjacent sides along a second weld line and a third weld line, respectively, wherein each side comprises a fourth weld line extending between the second weld line and the third weld line, an opening formed though a center of the first polygonal end, and an opening formed on at least one of the sides at a location midway between the first and second weld lines of the side. In yet a further exemplary embodiment, the fourth weld line of each side is not aligned with the fourth weld line of either of its adjacent sides. In another exemplary embodiment, the container further includes another opening formed through the center of the second polygonal end. In yet another exemplary embodiment, the container further includes a port welded to each opening.

DETAILED DESCRIPTION OF THE INVENTION

Figure 1A:
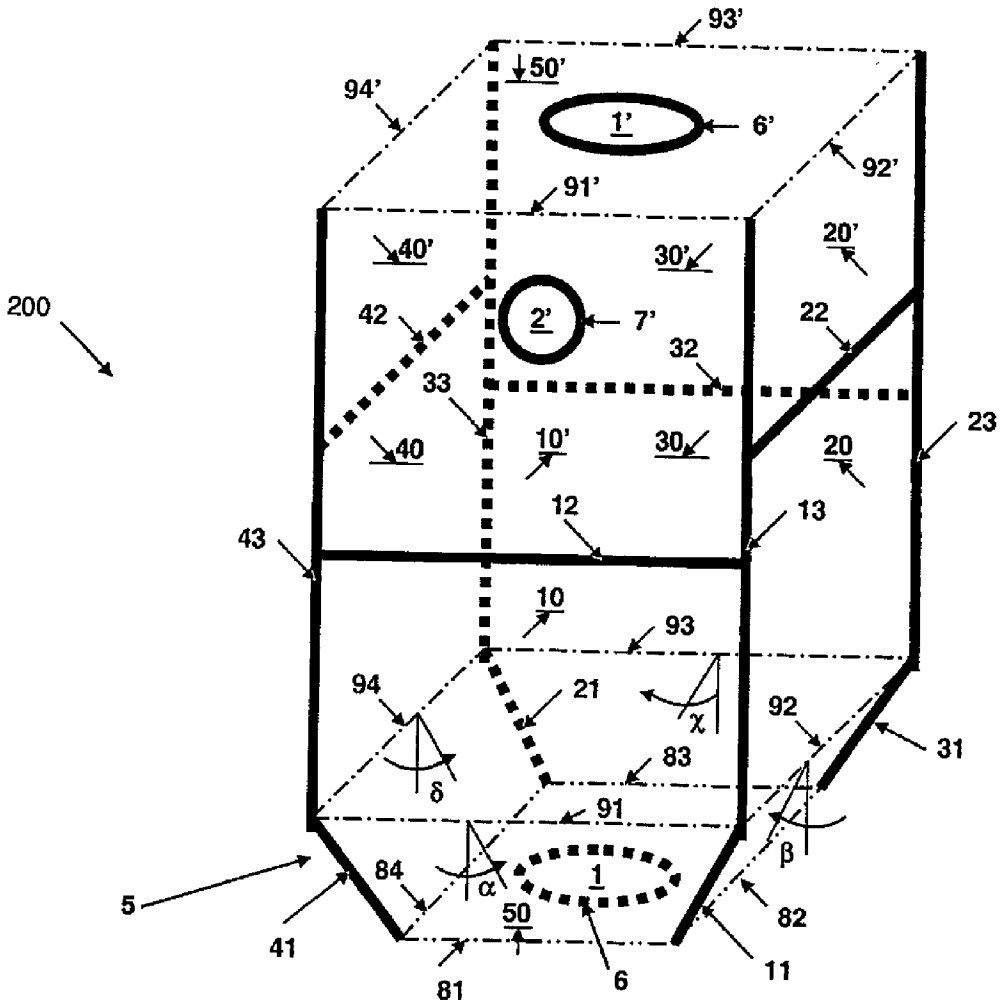
FIG. 1*a* shows a 3D view of a four-sided polyhedron-shaped disposable container having an elongated bottom projection according to one embodiment of the present invention.

The term "disposable" as used herein means any item designed for or capable of being disposed of after use, whereas use may be a one-time or multiple use as required by the pharmaceutical manufacturing process without the need to sterilize the entire pharmaceutical container more than one time.

The phrase "disposable container" as used herein, is not limited to the specifically enclosed embodiments. Disposable containers as used herein, include polyhedron-shaped bags such as rectangular, square and cylindrically shaped bags formed from single or multiple layer plastic film, with a gas or without a gas barrier, as commonly used for collection, dispensing, storing, mixing and processing of pharmaceutical raw materials and pharmaceutical products. The interior volume of the disposable container can be such as to accommodate research and development scale operations or commercial production scale operations. Typically the volume of the disposable container will be at least 10 mL, but typically at least 100 mL, but more typically at least 1 L, sizes of at least 10 L, at least 20 L, at least 50 L, at least 100 L, at least 200 L, at least 500 L, at least 1000 L, and even at least 10,000 L are possible. Disposable containers can be used unsupported but typically require a rigid wall outer container support.

The phrase "disposable mixer" as used herein, is not limited to the specifically enclosed embodiments. Disposable mixers, as used herein, include disposable containers with centerline positioned vibromixers used for mixing of pharmaceutical raw materials and pharmaceutical products.

The phrase "disposable bioreactor" as used herein, is not limited to the specifically enclosed embodiments. Disposable bioreactors, as used herein, include disposable containers with centerline positioned vibromixers equipped with or without disposable sensors for cell culture or fermentation.

The term "vibromixer" as used herein, is not limited to the specifically enclosed embodiments. Vibromixers, as used herein, are disk impellers that conclude at least one shaft and of at least one perforated plate which contains multiple roughly conical shaped perforations. The perforated plate is vibrated up and down, forcing jets of fluid out through tapered ends of the perforations. The perforated plane is aligned in a horizontal plane. The perforations can be aligned in a vertical plane to induce either up-flow or down-flow depending on their orientation, or angled relative to a vertical plane to induce lateral flow, or be aligned in any combinations thereof The orientation of the perforations or combinations thereof determines the axial and radial component pattern of the fluid velocity vectors and hence the degree of mixing. The shaft can be aligned in a vertical plane and is positioned at the centerline of the disposable container.

The term "polyhedron" as used herein means any three-dimensional (3D) shape that is made up of a finite number of polygonal faces. A polyhedron can have elongated polygonal projections on its top, bottom or side views. A polyhedron composed of the inner plastic film surfaces of the polygonal faces surrounds a bounded volume in a 3D space which represents the nominal capacity in volume of the polyhedron-shaped disposable container. Common polyhedra include cubes, prisms and pyramids that are symmetrical.

The phrase "polygon face", the terms "polygon" or "polygonal" as used herein mean any two-dimensional (2D) projected view obtained by cutting out an area of a weldable flat plastic film such that the 2D projected view is bounded by a closed path, composed of a finite sequence of straight line segments referred to as edges, which also represents the film cross section in the 3D view. The point where two edges meet is referred to as a vertex or corner point. A polygon face has an inner and outer side respectively corresponding to the inner and outer plastic film surface whereas "inner surface" refers to the product contact surface and "outer surface" refers to the surface in contact with the exterior environment.

The term "quadrilateral" refers to a four sided polygon.

The phrase "pharmaceutical raw materials" as used herein, is not limited to the specifically enclosed embodiments. Pharmaceutical raw materials, as used herein, include raw and in-process biological fluids and powders such as culture media and nutritional components; buffers; aqueous solutions and salt solutions or combinations thereof of varying pH, such as those used in dialysis, chromatography, crystallization, purification; processing solutions composed of either acids, alkali or antifoam agents; water; sanitizing and cleaning detergents; chaotropic solutions and buffers of varying pH for protein refolding; adjuvants; excipients; biological materials such as cells, cell debris, cellular components, viruses, antigens; and aliphatic and aromatic organic solvents, such as those used in chemical synthesis, chromatography, crystallization, and extraction.

The phrase "pharmaceutical products" as used herein, is not limited to the specifically enclosed embodiments. Pharmaceutical products, as used herein, include pharmaceutical and biological intermediate, and purified, formulated and finished bulk products.

The term "weldment" as used herein, defines any assembly that is made out of plastic that can be welded to a weldable plastic film such as for example ports having a single or multiple tube arrangement, dip tubes, shafts, agitator assemblies, valve bodies for addition, harvest and sampling, filter assemblies or sensor port plates.

Exemplary polyhedron-shaped disposable container of the present invention are described herein. In an exemplary embodiment, a four-sided polyhedron-shaped disposable container is provided that can have an elongated bottom projection designed to fit a rigid wall quadrilateral-based or cylindrically shaped bin, drum, tank, tote or hopper in various bottom configurations that are routinely used in various pharmaceutical liquid handling and processing applications, as for example shown in FIG. 1A. The exemplary embodiment disposable container 200 is a polyhedron with an elongated bottom projection 5 and comprising of one anterior polygonal face, composed of polygonal faces 10, 10', where part of the polygonal face 10 is folded inward by an angle $\alpha$ relative to a vertical plane along a film folding line 91; one posterior polygonal face, composed of polygonal faces 30, 30', where part of the polygonal face 30 is folded inward by an angle $\chi$ relative to a vertical plane along a film folding line 93; two lateral polygonal faces, a first one composed respectively of polygonal faces 20, 20' where part of the polygonal face 20 is folded inward by an angle $\beta$ relative to a vertical plane along a film folding line 92, and a second one composed of respectively faces 40, 40' where part of the polygonal face 40 is folded inward by an angle $\delta$ relative to a vertical plane along a film folding line 94; and one bottom shape which is the elongated bottom projection 5 comprising of a bottom polygonal face 50 and part of the polygonal faces 10, 20, 30, 40 respectively below the film folding lines 91, 92, 93, 94; and one top face 50'. In the shown exemplary embodiment, polygonal faces 10, 20, 30, and 40 above the film folding lines 91, 92, 93, 94 are quadrilateral sections having opposite parallel sides and below such folding lines are trapezoidal sections.

The polygonal face 10 is bounded by film folding line 81, inner film lap seams 11, 41, 12 and part of inner film lap seams 13, 43 below inner film lap seam 12. The polygonal face 10' is bounded by the film folding line 91', the inner film lap seam 12 and part of the inner film lap seams 13, 43 above inner film lap seam 12. The polygonal face 20 is bounded by film folding line 82, inner film lap seams 11, 31, 22 and part of the inner film lap seams 13, 23 below inner film lap seam 22. The polygonal face 20' is bounded by film folding line 92', inner film lap seam 22, and part of the inner film lap seams 13, 23 above inner film lap seam 22. Face 30 is bounded by film folding line 83, inner film lap seams 21, 31, 32 and part of the inner film lap seams 23, 33 below the inner film lap seam 32. The polygonal face 30' is bounded by film folding line 93', inner film lap seam 32 and part of the inner film lap seams 23, 33 above the inner film lap seam 32. The polygonal face 40 is bounded by film folding line 84, inner film lap seams 21, 41, 42 and part of the inner film lap seams 33, 43 below the inner film lap seam 42. The polygonal face 40' is bounded by film folding line 94', inner film lap seam 42 and part of the inner film lap seams 33, 43 above the inner film lap seam 42. The polygonal face 50 is bounded by the film folding lines 81 84 and the polygonal face 50' is bounded by the film folding lines 91'-94'. The shape of a polyhedron according to FIG. 1*a* where the elongated bottom projection is omitted can be determined by the lengths of the film folding lines 91-94, 91'-94' and the lengths of the inner film lap seams 13, 23, 33, 43. The shape of an elongated bottom projection according to FIG. 1*a* can be determined by the folding angles $\alpha$, $\beta$, $\chi$, $\delta$, or the length of the inner film lap seams 11, 21, 31, 41, and the length of the film folding lines 81-84 and 91-94.

In one exemplary embodiment of the current invention the polygonal faces 50, 50' and 10' have respectively one bottom weldment 1 bounded by a weld seam 6, one top weldment 1' bounded by a weld seam 6', and one side weld 2' bounded by a weld seam 7'. These weldments are not limited to one per said polygonal faces, can be welded anywhere in the said polygonal faces or in any other polygonal face. In an exemplary embodiment the weldments are welded at the center of the top and bottom polygonal faces 50, 50' thereby allowing assemblies to be aligned with the centerline or axis of a disposable container according to the current invention.

In one exemplary embodiment of the current invention the disposable container 200 is a polyhedron according to. FIG. 1*a* wherein the film folding lines 91, 91', 93, 93' all have the same length, and wherein the film folding lines 92, 92', 94, 94' all have the same length which can have the same length or a different length than the film folding lines 91, 91', 93, 93', with this embodiment the film folding angles $\alpha$, $\beta$, $\chi$, $\delta$ are the same, resulting in polyhedron-shaped disposable containers having respectively the same square or rectangular shaped top and bottom and an elongated symmetrical, respectively square or rectangular shaped polygonal bottom projection. Such disposable containers can be used to fit rigid wall outer containers such as symmetrical bins, tanks, totes and hoppers that have a square or rectangular shaped bottom projection. Square and rectangular shaped symmetrical bins, tanks, totes and hoppers with symmetrical square and rectangular bottom projections are readily available from a variety of manufacturers.

In another exemplary embodiment of the current invention the disposable container 200 is a polyhedron according to FIG. 1*a* wherein the elongated polygonal bottom projection 5 is omitted and wherein the film folding lines 91, 91', 93, 93' all have the same length, and wherein the film folding lines 92, 92', 94, 94' all have the same length and can have the same length or a different length than the film folding lines 91, 91', 93, 93', resulting in polyhedron-shaped disposable containers having respectively the same square or rectangular shaped top and bottom. Such disposable containers can be used to fit rigid wall outer containers such as symmetrical bins, tanks, totes, intermediate bulk containers with square or rectangular bottom shapes. Square and rectangular shaped symmetrical bins, tanks, totes and intermediate bulk containers are readily available from a variety of manufacturers.

In another exemplary embodiment of the current invention the disposable container 200 is a polyhedron according to FIG. 1*a* wherein the film folding lines 91, 91', 92, 92', 93, 93', 94, 94' all have the same length, and wherein the film folding angles α, β, χ, δ are the same and can be between 1°-89°, resulting respectively in polyhedron-shaped disposable containers having a square shaped top and bottom and an elongated polygonal bottom projection 5. Such disposable containers can be used to fit rigid wall outer containers such as cylindrical shaped drums or tanks having various bottom shapes such as standard or variant dished heads, F&D (flanged and dished) heads, semi-elliptical, spherical, conical and hemispherical bottom heads. This is possible because of the flexural properties of such disposable container under load. The outer circumference of such disposable container requires it to be the same as the inner circumference of the rigid wall cylindrical shaped outer container for which it is designed to fit. The degree of fit of the disposable container towards an inner contour of a cylindrical shaped outer container depends on the flexural properties of the plastic film, and the size of the outer container. Cylindrical shaped drums or tanks with various bottom shapes are readily available from a variety of manufacturers.

In yet another exemplary embodiment of the current invention the disposable container 200 is a polyhedron according to FIG. 1*a* wherein the elongated bottom projection is omitted and the film folding lines 91, 91', 92, 92', 93, 93', 94, 94' all have the same length, resulting in polyhedron-shaped disposable containers having a square-shaped top and bottom. Such disposable containers can be used to fit rigid wall outer containers such as flat bottom cylindrical shaped drums or tanks due to the flexural properties of said disposable container under load. The outer circumference of said disposable container requires it to be the same as the inner circumference of the rigid wall cylindrical shaped outer container for which it is designed to fit. The degree of fit of said disposable container towards an inner contour of a cylindrical shaped outer container depends on the flexural properties of the plastic film, and the size of the outer container. Flat bottom cylindrical shaped drums and tanks are readily available from a variety of manufacturers.

In a further exemplary embodiment of the current invention the disposable container 200 is a polyhedron according to FIG. 1*a* wherein the polygonal top face 50' is exchanged for an elongated top projection which can be the inverse of an elongated polygonal bottom projection 5 or can be a different elongated polygonal projection. Equally the resulting disposable containers can be used to fit rigid wall outer containers such as rectangular, square and cylindrical shaped bins, tanks, drums, totes, hoppers, having various top projections.

In yet another exemplary embodiment the polyhedron-shaped disposable containers 200 is a polyhedron according to FIG. 1*a* that can be rotated by 90° relative to a vertical plane to accommodate rigid wall outer containers such as rectangular, square and cylindrical shaped bins, tanks, drums, totes, hoppers, having elongated polygonal side projections.

In a further exemplary embodiment, a six-sided polyhedron-shaped disposable container is provided that can have an elongated bottom projection designed to fit a rigid wall quadrilateral-based or cylindrically shaped bin, drum, tank, tote or hopper in various bottom configurations that are routinely used in various pharmaceutical liquid handling and processing applications.

Figure 1B:
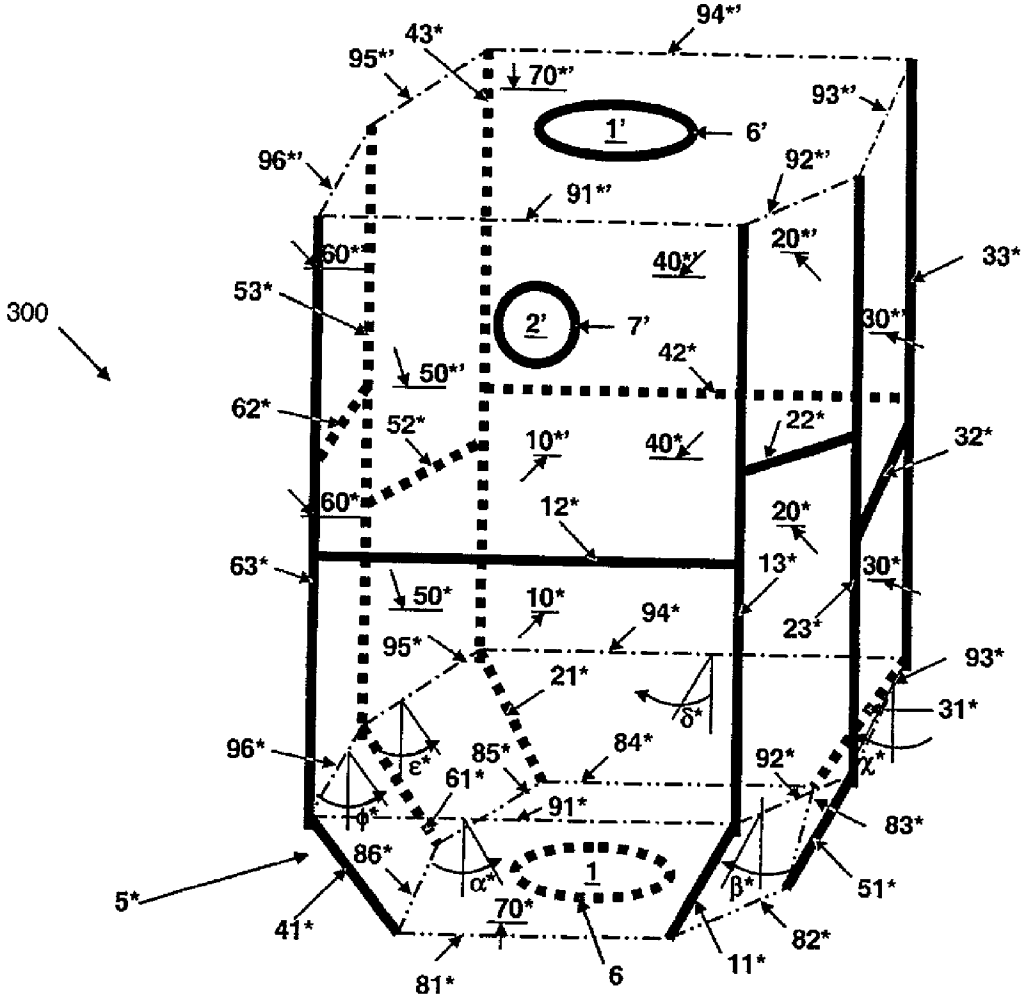
FIG. 1*b* shows a 3D view of a six-sided polyhedron-shaped disposable container having an elongated bottom projection according to one embodiment of the present invention.

In one exemplary embodiment shown in FIG. 1*b* a disposable container 300 is a polyhedron with an elongated bottom projection 5* comprising of one anterior polygonal face, composed of polygonal faces 10*, **10*', where part of the polygonal face 10*** is folded inward by an angle α* relative to a vertical plane along a film folding line 91*; one polygonal posterior face, composed of polygonal faces 40* and **40*', where part of the face 40*** is folded inward by an angle δ* relative to a vertical plane along a film folding line 94*; four lateral polygonal faces, a first one composed respectively of polygonal faces 20*, **20*' where part of the polygonal face 20*** is folded inward by an angle β* relative to a vertical plane along a film folding line 92*, a second one composed of respectively polygonal faces 30*, **30*' where part of the polygonal face 30*** is folded inward by an angle χ* relative to a vertical plane along a film folding line 93*, a third one composed of respectively polygonal faces 50*, **50*' where part of the polygonal face 50*** is folded inward by an angle ϵ* relative to a vertical plane along a film folding line 95*, and a fourth one composed of respectively polygonal faces 60*, **60*' where part of the polygonal face 60*** is folded inward by an angle ϕ* relative to a vertical plane along a film folding line 96*; one bottom shape which is an elongated projection comprising of a bottom face 70* and part of the faces 10*, 20*, 30*, 40*, 50*, 60* respectively below the film folding lines 91*, 92*, 93*, 94*, 95*, 96*; and one top face **70*'**.

The polygonal face 10* is bounded by the film folding line 81*, the inner film lap seams 11*, 41*, 12* and part of the inner film lap seams 13*, 63* below inner film lap seam 12*. The polygonal face **10*' is bounded by the film folding line 91*', the inner film lap seam 12* and part of the inner film lap seams 13*, 63* above inner film lap seam 12*. The polygonal face 20* is bounded by the film folding line 82*, the inner lap seams 11*, 51*, 22* and part of the inner film lap seams 13*, 23* below inner film lap seam 22*. The polygonal face 20*' is bounded by the film folding line 92*', the inner film lap seam 22*, and part of the inner film lap seams 13*, 23* above inner film lap seam 22*. Face 30* is bounded by the film folding line 83*, the inner film lap seams 31*, 51*, 32* and part of the inner film lap seams 23*, 33* below inner film lap seam 32*. The polygonal face 30*' is bounded by the film folding line 93*', the inner film lap seam 32* and part of the inner film lap seams 23*, 33* above the inner film lap seam 32*. The polygonal face 40* is bounded by the film folding line 84*, the inner lap seams 21*, 31*, 42* and part of the inner film lap seams 33*, 43* below the inner film lap seam 42*. The polygonal face 40*' is bounded by the film folding line 94*', the inner film lap seam 42* and part of the inner film lap seams 33*, 43* above the inner lap seam 42*. The polygonal face 50* is bounded by the film folding line 85*, the inner film lap seams 21*, 61*, 52* and part of the inner film lap seams 43*, 53* below the inner lap seam 52*. The polygonal face 50*' is bounded by the film folding line 95*', the inner film lap seam 52* and part of the inner film lap seams 43*, 53* above the inner film lap seam 52*. The polygonal face 60* is bounded by the film folding line 86*, the inner film lap seams 41*, 61*, 62* and part of the inner film lap seams 53*, 63* below the inner lap seam 62*. The polygonal face 60*' is bounded by the film folding line 96*', the inner film lap seam 62* and part of the inner film lap seams 53*, 63* above the inner lap seam 62*.The polygonal face 70* is bounded by the film folding lines 81*-86* and the polygonal face 50*' is bounded by the film folding lines 91*'-96*'**.

In another exemplary embodiment a polyhedron according to FIG. 1 b is provided wherein the elongated bottom projection is omitted and its shape is determined by the lengths of the film folding lines **91*-96*, 91*'-96*' and the lengths of the inner film lap seams 13*, 23*, 33*, 43*, 53*, 63***.

The shape of an elongated bottom projection 5* according to FIG. 1*b* can be determined by the folding angles $\alpha^*$, $\beta^*$, $\chi^*$, $\delta^*$, $\epsilon^*$, $\phi^*$ or the length of the inner film lap seams 11*, 21*, 31*, 41*, 51*, 61*, and the length of the film folding lines **81*-86* and 91*-96***.

In a further exemplary embodiment of the current invention the disposable container 300 is a polyhedron according to FIG. 1*b* wherein the film folding lines 91*, **91*', 92*, 92*', 93*, 93*', 94*, 94*', 95*, 95*', 96*, 96*'** all have the same length, and wherein the folding angles $\alpha^*$, $\beta^*$, $\chi^*$, $\delta^*$, $\epsilon^*$, $\phi^*$ are the same and can be between 1°-89°, resulting respectively in polyhedron-shaped disposable containers having a hexagonal-shaped top and bottom and an elongated polygonal bottom projection. Such disposable containers can be used to fit rigid wall outer containers such as cylindrical shaped drums or tanks having various bottom shapes such as standard or variant dished heads, F&D (flanged and dished) heads, semi-elliptical, spherical, conical and hemispherical bottom heads. This is possible because of the flexural properties of said disposable containers under load. The outer circumference of said disposable requires it to be the same as the inner circumference of the rigid wall cylindrical shaped outer container for which it is designed to fit. The degree of fit of said disposable container towards an inner contour of a cylindrical shaped outer container depends on the flexural properties of the plastic film, and the size of the outer container. Cylindrical shaped drums or tanks with various bottom shapes are readily available from a variety of manufacturers.

In yet another exemplary embodiment of the current invention the disposable container 300 is a polyhedron according to FIG. 1*b* wherein the elongated bottom projection is omitted and the film folding lines 91*, **91*', 92*, 92*', 93*, 93*', 94*, 94*', 95*, 95*', 96*, 96*'** all have the same length, resulting in polyhedra-shaped disposable containers having a hexagonal-shaped top and bottom. These disposable containers can be used to fit rigid wall outer containers such as flat bottom cylindrical shaped drums or tanks. This is possible because of the flexural properties of said disposable container under load. The degree of fit of said disposable container towards an inner contour of a cylindrical shaped outer container requires its inner circumference to be the same as the circumference of said disposable container. It also depends on the flexural properties of the plastic film, the size of the outer container. Flat bottom cylindrical shaped drums and tanks are readily available from a variety of manufacturers.

To manufacture a four-sided polyhedron-shaped disposable container 200 having one elongated bottom shape, the following seven example steps are used.

Figure 2:
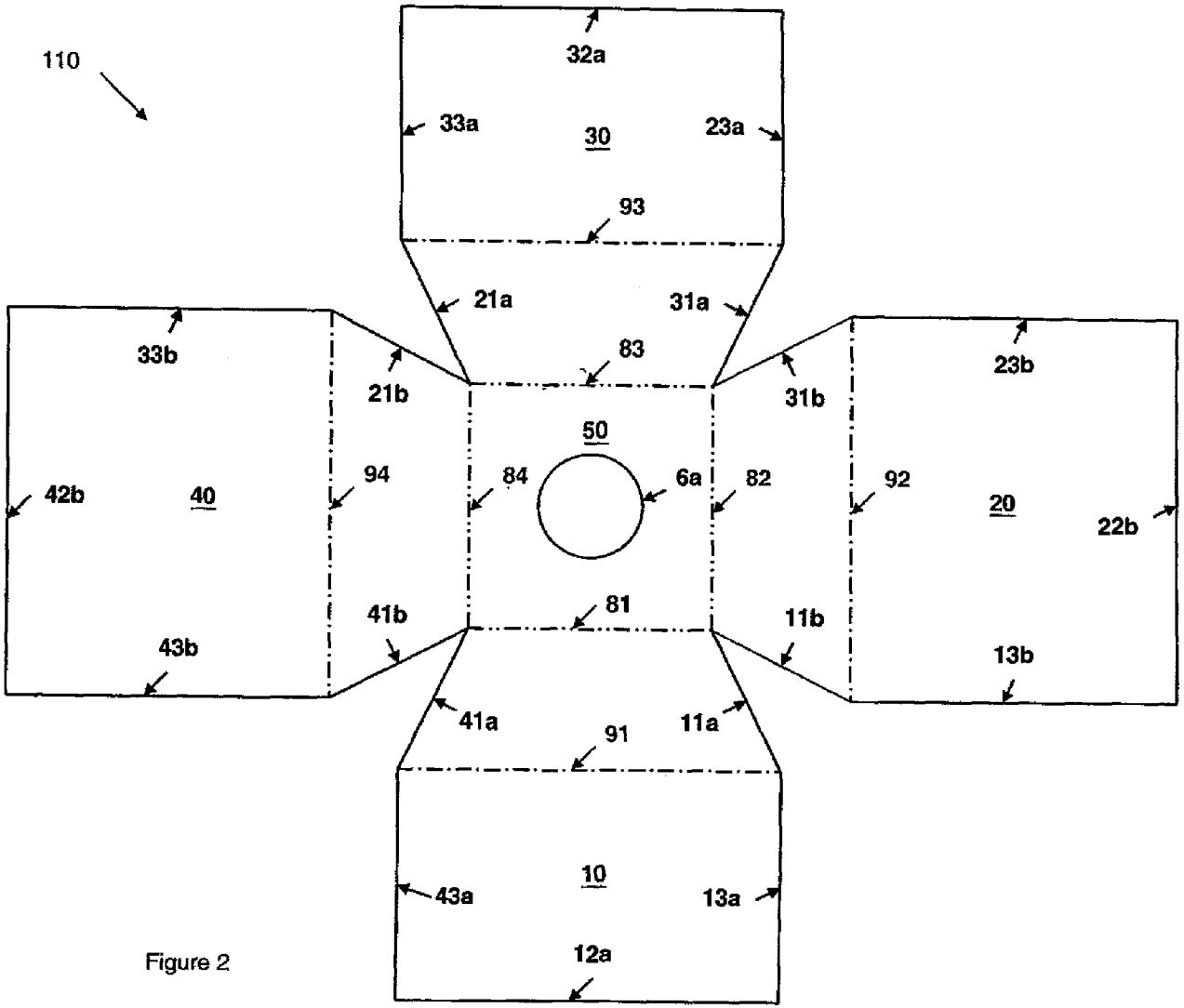
FIG. 2 shows a 2D projected view of an unfolded polyhedron-shaped bottom shape used to manufacture the bottom part of a four-sided polyhedron-shaped disposable container having an elongated bottom projection according to one embodiment of the present invention.

In step one, a 3D design drawing of a bottom part of a four-sided polyhedron-shaped disposable container 200 having one elongated bottom shape and having polygonal faces 10, 20, 30, 40 and 50 is unfolded, then oversized by ⅛ to ⅜ inch on all weld edges to account for the thickness of the film lap seams, then projected in actual dimensions on to a 2D plane, and then cut out of a weldable plastic film by means of for example a press, or laser cutting tools, or CNC cutting tools, as known in the art. Then, and in one exemplary embodiment, one, preferably circular, opening 6*a* is cut out in polygonal face 50 by means of for example a press, or laser cutting tools, or CNC cutting tools, as known in the art. FIG. 2 shows a 2D projected view 110 of an unfolded polygonal bottom shape that is cut out of a weldable plastic film to form the bottom part of a four-sided polyhedron-shaped disposable container 200 having one elongated bottom shape according to one exemplary embodiment of the current invention. The 2D projected view 110 consists of five polygonal faces 10, 20, 30, 40, 50. Polygonal face 10 is bounded by film edges 11*a*, 13*a*, 12*a*, 43*a*, 41*a*, and film folding line 81. Polygonal face 20 is bounded by film edges 11*b*, 13*b*, 22*b*, 23*b*m , 31*b*, and film folding line 82. Polygonal face 30 is bounded by film edges 21*a*, 33*a*, 32*a*, 23*a*, 31*a*, and film folding line 83. Polygonal face 40 is bounded by film edges 21*b*, 33*b*, 42*b*, 43*b*, 41*b*, and film folding line 84. Polygonal face 50 is bounded by film edge 6*a*, and film folding lines 81, 82, 83, 84.

Figure 3:
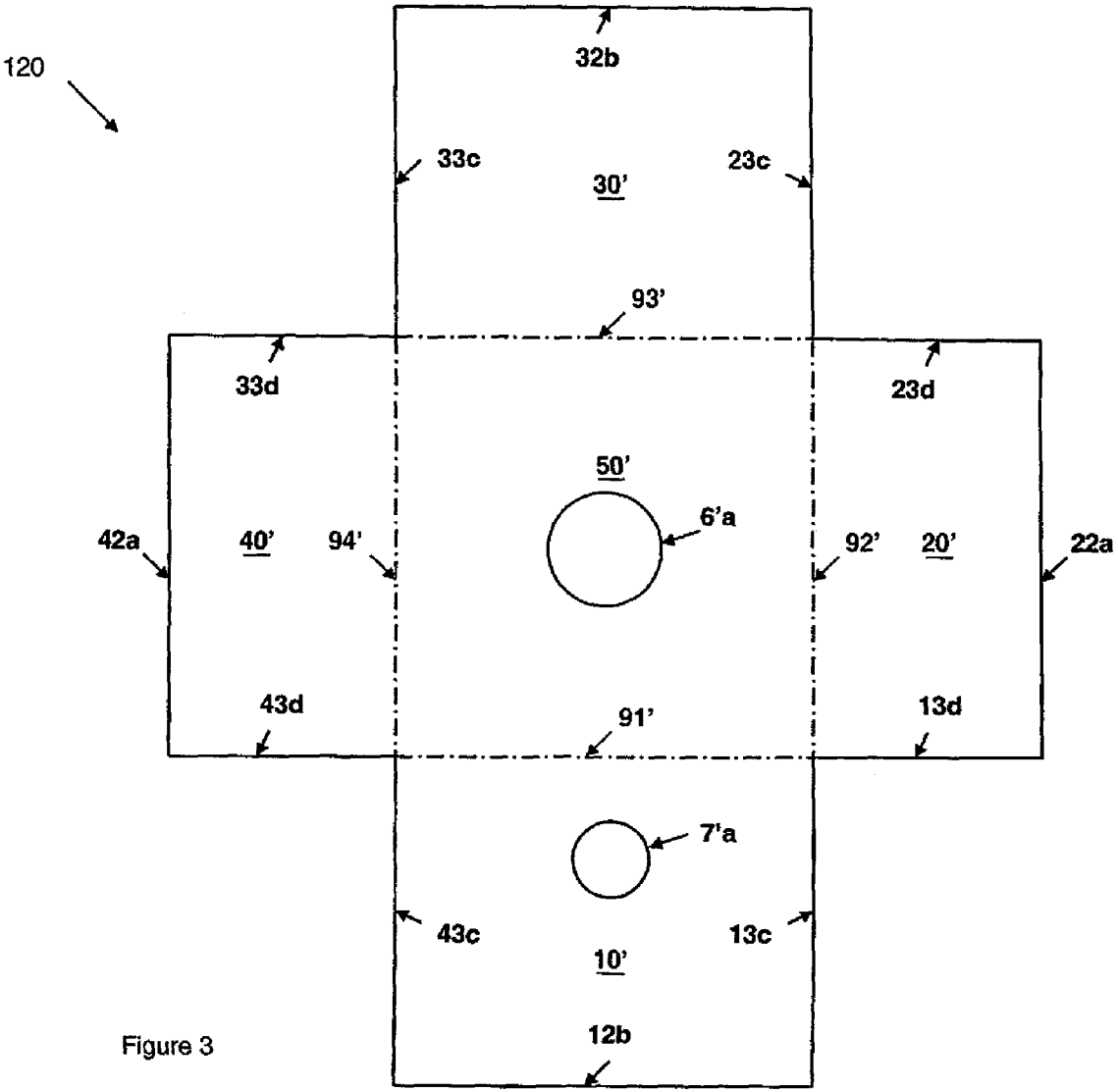
FIG. 3 shows a 2D projected view of an unfolded polyhedron-shaped top shape used to manufacture the top part of a four-sided polyhedron-shaped disposable container according to one embodiment of the present invention.

In step two, a 3D design drawing of a top part of a four-sided polyhedron-shaped disposable container 200 having polygonal faces 10', 20', 30', 40', 50' is unfolded, then oversized by ⅛ to ⅜ inch on all weld edges to account for the thickness of the film lap seams, then projected in actual dimensions on to a 2D plane, and then cut out of a weldable plastic film by means of for example a press, or laser cutting tools, or CNC cutting tools, as known in the art. Then, and in one exemplary embodiment, two, preferably circular, openings 6'*a* and 7'*a* are cut out respectively in polygonal faces 50' and 10' by means of for example a press, or laser cutting tools, or CNC cutting tools, as known in the art. FIG. 3 shows a 2D plane view 120 of an unfolded polygonal top shape that is cut out of a weldable plastic film to form the top part of a four-sided polyhedron-shaped disposable container 200 shape according to one exemplary embodiment of the current invention. The 2D projected view 120 consists of five polygonal faces 10', 20', 30' 40', 50'. Polygonal face 10' is bounded by film edges 13*c*, 12*b*, 43*c*, by an edge of opening 7'*a*, and film folding line 91'. Polygonal face 20' is bounded by film edges 13*d*, 22*a*, 23*d*, and film folding line 92'. Polygonal face 30' is bounded by film edges 23*c*, 32*b*, 33*c*, and film folding line 93'. Polygonal face 40 is bounded by film edges 33*d*, 42*a*, 43*d*, and film folding line 94'. Polygonal face 50' is bounded by the edge of opening 6'*a*, and film folding lines 91', 92', 93', 94'.

In step three, and in one exemplary embodiment, the four-sided polyhedron-shaped disposable container 200 contains, bottom weldment 1, top weldment 1', and side weldment 2'. Said weldments are welded respectively to the film edges of opening 6*a* of the bottom film cut out 110, and 6'*a*, 7'*a* of the top film cut out 120 as depicted respectively in FIG. 2 and FIG. 3. Said weldments are welded by means of a circular impulse, heat, laser, ultrasound, high or radio frequency port welder, to form respectively inner film lap seams 6, 6', 7' according to one exemplary embodiment of the current invention.

Figure 4:
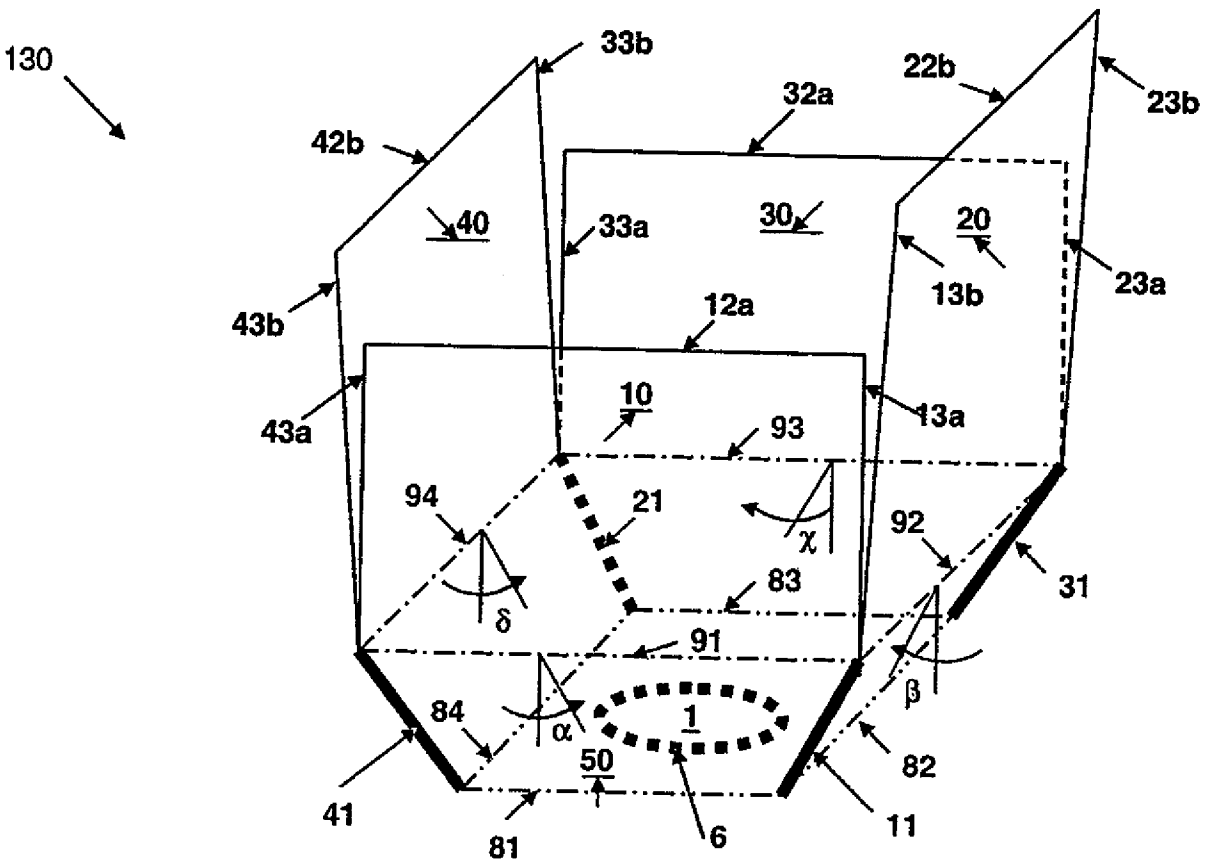
FIG. 4 shows a 3D perspective of an inward folded bottom part of a four-sided polyhedron-shaped disposable container wherein the elongated bottom projection is welded according to one embodiment of the present invention.

In step four, the 2D film cut out 110 as depicted in FIG. 2 of an unfolded polygonal bottom shape of a four-sided polyhedron-shaped disposable container 200 having one elongated bottom shape is folded inward along the film folding lines 81-84 and 91-94. Then, the pairs of corresponding film edges 11*a* and 11*b*, 21*a* and 21*b*, 31*a* and 31*b*, 41*a* and 42*b* are welded together respectively in any order of diagonally opposite edges, by means of a straight bar impulse, heat, laser, ultrasound, high or radio frequency welder to form respectively inner film lap seams 11, 21, 31, 41 protruding outward of the polygonal bottom shape. Said inner film lap seams 11, 21, 31, 41 are by way of convention categorized in a first film lap weld group I reference numeral comprising of an array of two digits wherein the first digit represents the welding sequence number in increasing numerical order starting with "1" and ending with "4", and the second digit represents the film lap weld group I designated by the number "1". FIG. 4 shows a 3D perspective of a bottom part 130 of a four-sided polyhedron-shaped disposable container 200 having one elongated bottom shape wherein the polygonal faces 10, 20, 30, 40 are folded inward and wherein the elongated bottom shape is welded according to one exemplary embodiment of the current invention.

Figure 5:
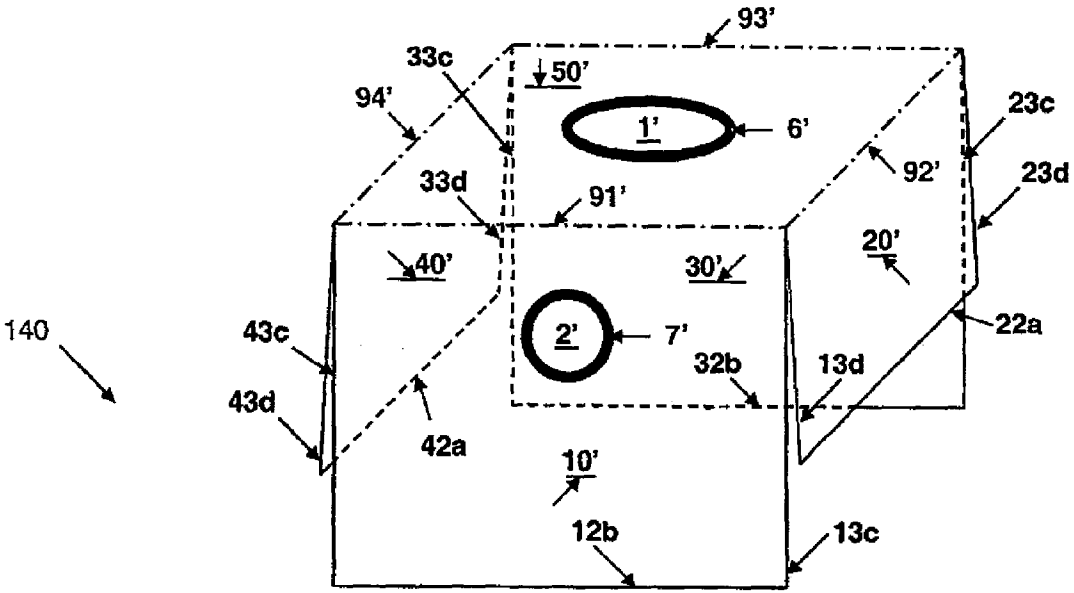
FIG. 5 shows a 3D perspective of an inward folded top part of a four-sided polyhedron-shaped disposable container according to one embodiment of the present invention.

In step five, the 2D projected view 120 as depicted in FIG. 3 of an unfolded polygonal top shape of a four-sided polyhedron-shaped disposable container 200 is folded inward along the film folding lines 91'-94'. FIG. 5 shows a 3D perspective of a top part 140 of a four-sided polyhedron-shaped disposable container 200 according to one exemplary embodiment of the current invention.

Figure 6:
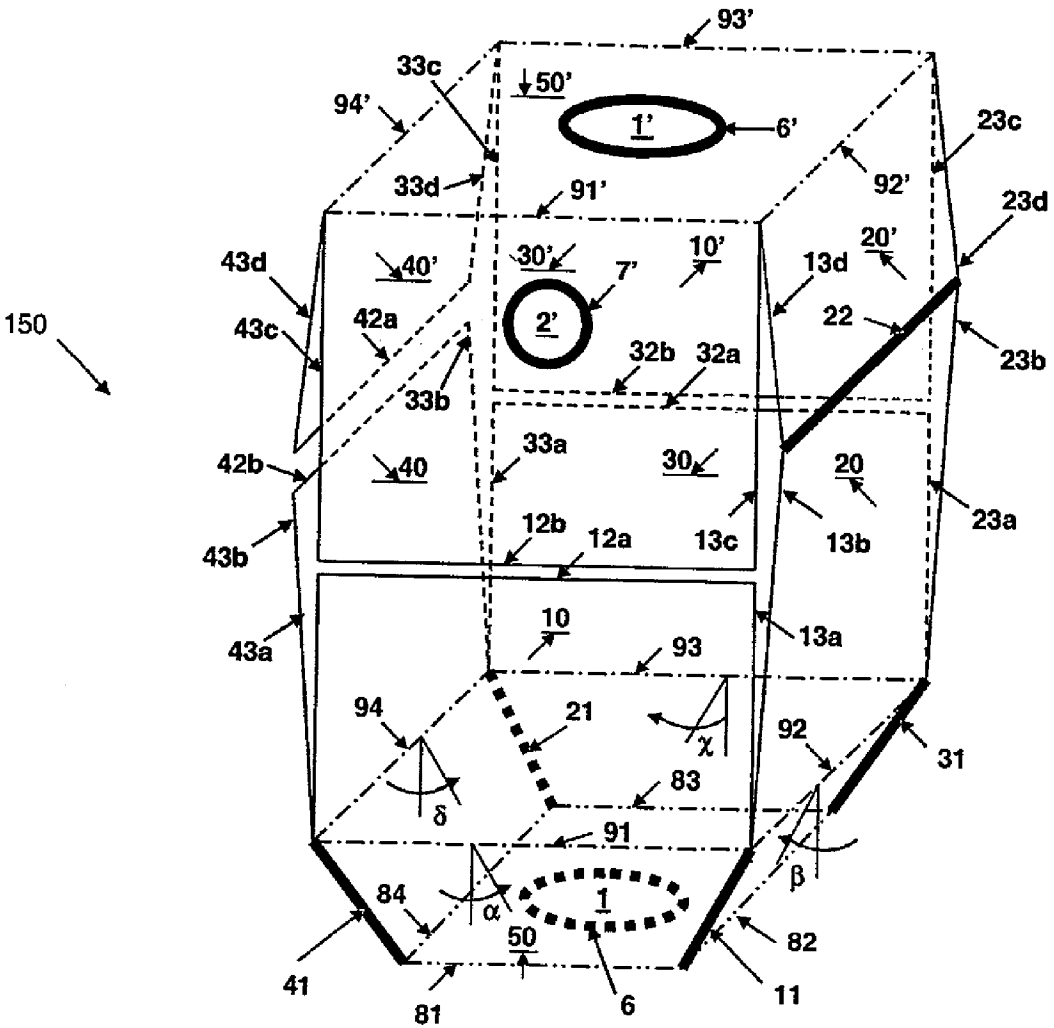
FIG. 6 shows a 3D perspective of an aligned top and bottom part of a four-sided polyhedron-shaped disposable container wherein the elongated bottom projection is welded, and two corresponding polygonal faces are welded along corresponding first film edges according to one embodiment of the present invention.
Figure 7:
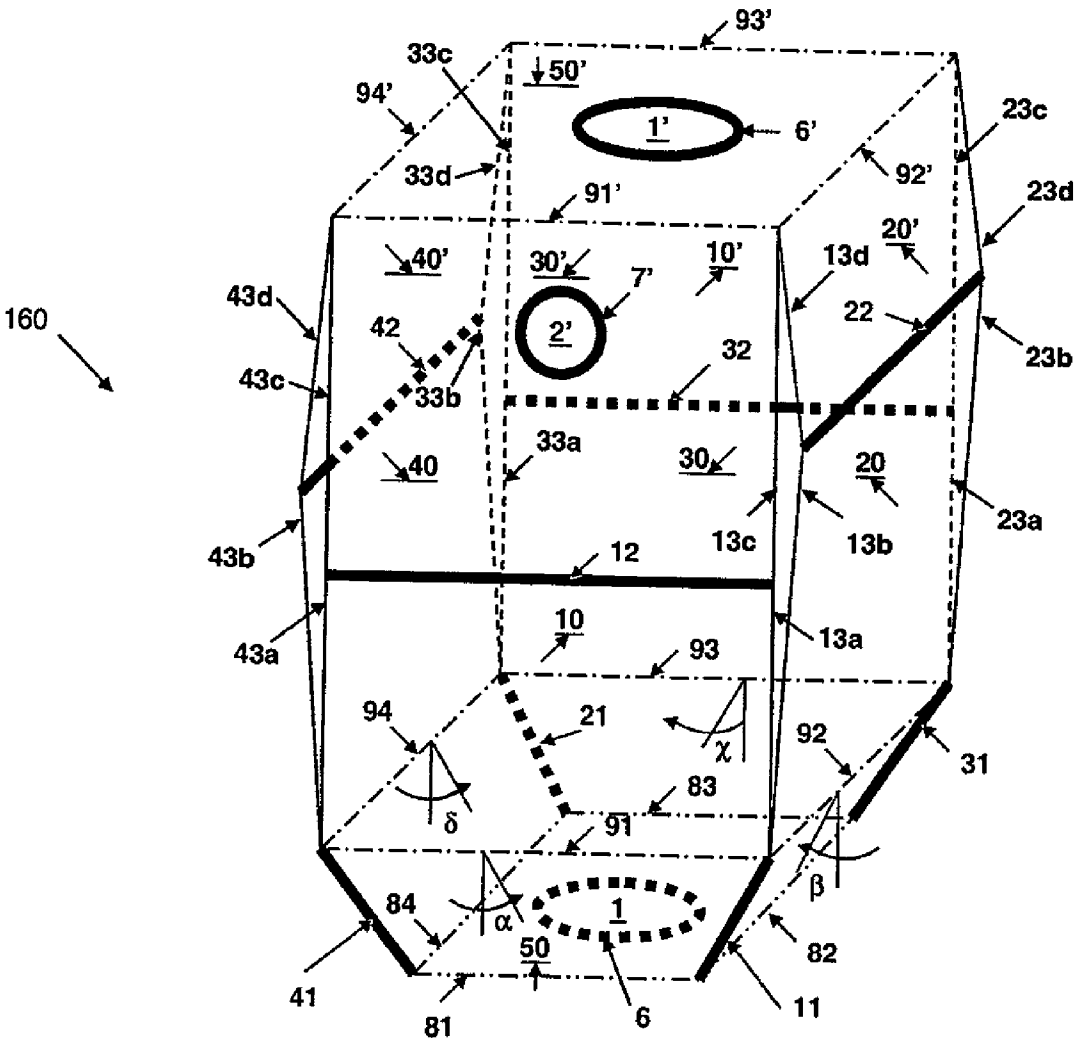
FIG. 7 shows a 3D perspective of an aligned top and bottom part of a four-sided polyhedron-shaped disposable container wherein the elongated bottom projection is welded, and eight corresponding polygonal faces are welded along corresponding first film edges according to one embodiment of the present invention.

In step six, the 3D folded film cut outs 130 and 140 respectively depicted in FIG. 4 and FIG. 5 are aligned in such a way that the corresponding polygonal faces 10 and 10', 20 and 20', 30 and 30', and 40 and 40' line up to create the contours of a four-sided polyhedron-shaped disposable container having one elongated bottom shape. Then, the corresponding film edges 12*a* and 12*b*, 22*a* and 22*b*, 32*a* and 32*b*, 42*a* and 42*b* are welded together in pairs of two edges respectively in clockwise or counterclockwise order, by means of a straight bar impulse, heat, laser, ultrasound, high or radio frequency welder to form respectively inner film lap seams 12, 22, 32, 42 protruding outward of the four-sided polyhedron-shaped disposable container. Said inner film lap seams 12, 22, 32, 42 are by way of convention categorized in a second film lap weld group II using reference numerals comprising of an array of two digits wherein the first digit represents the welding sequence number in increasing numerical order starting with "1" and ending with "4", and the second digit represents the film lap weld group II designated by the number "2". FIG. 6 shows a 3D perspective of an aligned top and bottom part 150 of a four-sided polyhedron-shaped disposable container having an elongated bottom shape wherein by way of example the corresponding polygonal faces 20 and 20' are welded along side their corresponding film edges 22*a* and 22*b* to form an inner film seam 22 which protrudes outwards of the four-sided polyhedron-shaped disposable container according to one exemplary embodiment of the current invention. FIG. 7 shows a 3D perspective of an aligned top and bottom part 160 of a four-sided polyhedron-shaped disposable container having an elongated bottom shape wherein the corresponding polygonal faces 10 and 10', 20 and 20', 30 and 30', 40 and 40' are welded along side their corresponding film edges 12*a* and 12*b*, 22*a* and 22*b*, 32*a* and 32*b*, 42*a* and 42*b* to form respectively inner film seams 12, 22, 32, 42 which protrude outwards of the four-sided polyhedron-shaped disposable container according to one exemplary embodiment of the current invention.

Figure 8:
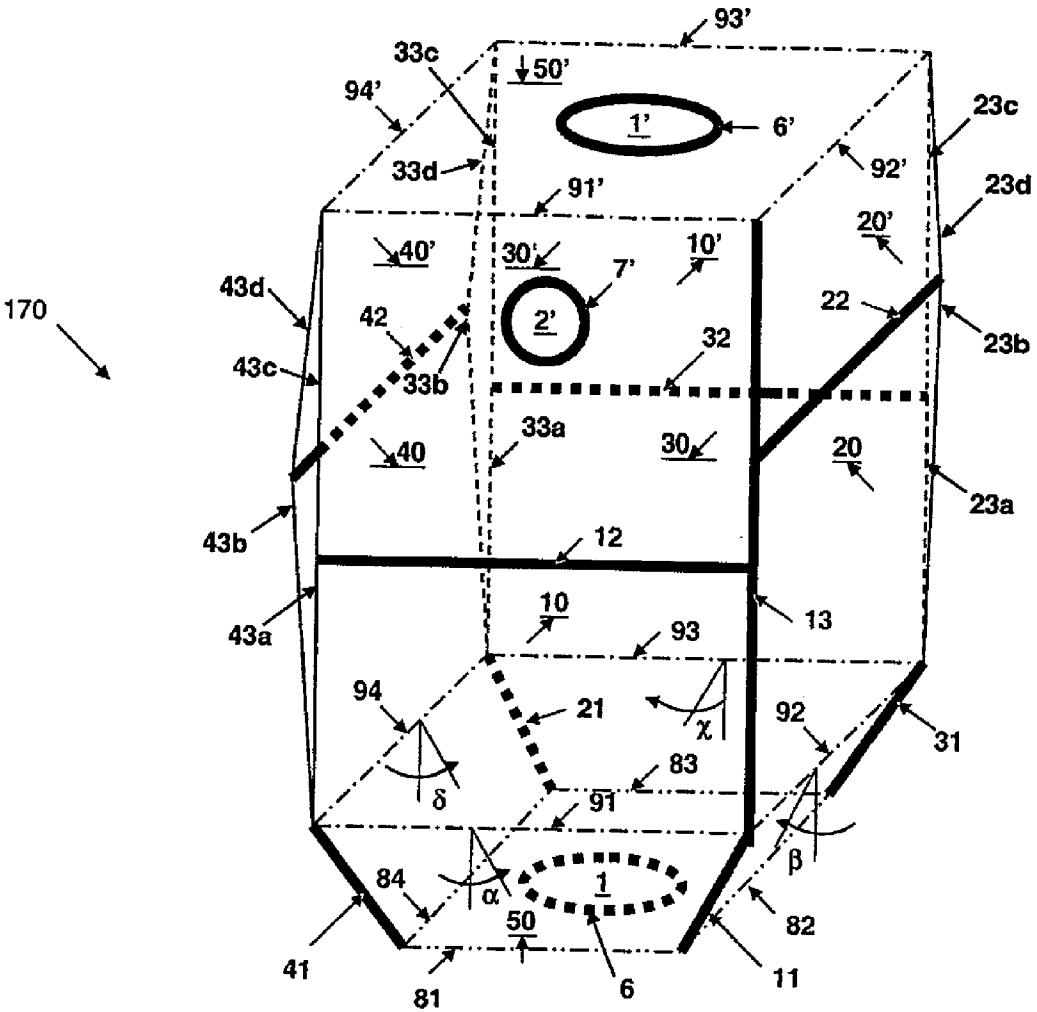
FIG. 8 shows a 3D perspective of an aligned top and bottom part of a four-sided polyhedron-shaped disposable container wherein the elongated bottom projection is welded, four corresponding polygonal faces are welded along corresponding first film edges, and four corresponding polygonal faces are welded alongside corresponding second film edges according to one embodiment of the present invention.

In step seven, the four-sided polyhedron-shaped disposable container 160 having one elongated bottom shape is aligned in such a way that the corresponding polygonal faces 10, 20, 10', 20'; and 20, 30, 20', 30'; and 30, 40, 30', 40'; and 10, 40, 10', 40' are lined up to create the contours of a four-sided polyhedron-shaped disposable container having one elongated bottom shape. Then, the corresponding film edges 13*a*, 13*b*, 13*c*, 13*d*; and 23*a*, 23*b*, 23*c*, 23*d*; and 33*a*, 33*b*, 33*c*, 33*d*; and 43*a*, 43*b*, 43*c*, 43*d* are welded together in groups of four edges respectively in clockwise or counterclockwise order, by means of a straight bar impulse, heat, ultrasound, high or radio frequency welder to form respectively inner film lap seams 13, 23, 33, 43 protruding outward of the four-sided polyhedron-shaped disposable container. Said inner film lap seams 13, 23, 33, 43 are by way of convention categorized in a third film lap weld group III using a reference numeral comprising of an array of two digits wherein the first digit represents the welding sequence number in increasing numerical order starting with "1" and ending with "4", and the second digit represents the film lap weld group III designated by the number "3". FIG. 8 shows a 3D perspective of an aligned top and bottom part 170 of a four-sided polyhedron-shaped disposable container having and elongated bottom shape wherein by way of example the corresponding polygonal faces 10, 20, 10', 20' are welded along side their corresponding film edges 13*a*, 13*b*, 13*c*, 13*d* to form inner film seam 13 which protrudes outwards of the four-sided polyhedron-shaped disposable containers according to one exemplary embodiment of the current invention In an exemplary embodiment, a multi-sided polyhedron-shaped disposable container having one elongated bottom projection is manufactured as follows.

In step one, a 3D design drawing of a bottom part of a multi-sided polyhedron-shaped disposable container having one elongated bottom projection and having multiple polygonal faces is unfolded, then oversized by ⅛ to ⅜ inch on all weld edges to account for the thickness of the film lap seams, then projected in actual dimensions on to a 2D plane, and then cut out of a weldable plastic film by means of for example a press, or laser cutting tools, or CNC cutting tools, as known in the art. Then, if required by the application, preferably circular openings can be cut out anywhere and in any polygonal face by means of for example a press or laser cutting tools, or CNC cutting tools, as known in the art.

In step two, a 3D design drawing of a top part of a multi-sided polyhedron-shaped disposable container having multiple polygonal faces is unfolded, then oversized by ⅛ to ⅜ inch on all weld edges to account for the thickness of the film lap seams, then projected in actual dimensions on to a 2D plane, and then cut out of a weldable plastic film by means of for example a press, or laser cutting tools, or CNC cutting tools, as known in the art. Then, if required by the application, preferably circular openings can be cut out anywhere and in any polygonal face by means of for example a press or laser cutting tools, or CNC cutting tools, as known in the art.

In step three, if required by the application, bottom, top and side weldments, as the case may be, are welded to the film edges of said preferably circular opening cut outs in the weldable plastic film in step on and step two. Said weldments are welded by means of a circular impulse, heat, laser, ultrasound, high or radio frequency port welder, to form respectively inner film lap seams.

In step four, the 2D film cut out of an unfolded polygonal bottom shape of a multi-sided polyhedron-shaped disposable container having one elongated bottom projection is folded inward along the film folding lines. Then, the pairs of corresponding film edges are welded together respectively in any order of diagonally opposite edges, by means of a straight bar impulse, heat, laser, ultrasound, high or radio frequency welder to form respectively inner film lap seams protruding outward of the polygonal bottom shape. Said inner film lap seams are by way of convention categorized in a first film lap weld group I comprising of an array of two digits wherein the first digit represents the welding sequence number starting with "1" and in increasing numerical order up to the number determined by the number of sides of the multi-sided polyhedron-shaped disposable container, and the second digit represents the film lap weld group I designated by the number "1".

In step five, the 2D film cut out of an unfolded polygonal top shape of a multi-sided polyhedron-shaped disposable container is folded inward along the film folding lines.

In step six, the 3D folded and partially welded film cut out of step four and the 3D folded film cut out from step five are aligned in such a way that the corresponding polygonal faces line up to create the contours of a multi-sided polyhedron-shaped disposable container having one elongated bottom shape. Then, the corresponding horizontal film edges are welded together in pairs of two edges respectively in clockwise or counterclockwise order, by means of a straight bar impulse, heat, laser, ultrasound, high or radio frequency welder to form respectively inner film lap seams protruding outward of the multi-sided polyhedron-shaped disposable container. Said inner horizontal film lap seams are by way of convention categorized in a second film lap weld group II using reference numerals comprising of an array of two digits wherein the first digit represents the welding sequence number starting with "1" and in increasing numerical order up to the number determined by the number of sides of the multi-sided polyhedron-shaped disposable container, and the second digit represents the film lap weld group II designated by the number "2".

In step seven, the multi-sided polyhedron-shaped disposable container having one elongated bottom shape of step six is aligned in such a way that the corresponding polygonal faces are lined up to create the contours of a four-sided polyhedron-shaped disposable container having one elongated bottom shape. Then, the corresponding vertical film edges are welded together in groups of four edges respectively in clockwise or counterclockwise order, by means of a straight bar impulse, heat, ultrasound, high or radio frequency welder to form respectively inner film lap seams protruding outward of the multi-sided polyhedron-shaped disposable container. Said inner vertical film lap seams are by way of convention categorized in a third film lap weld group III using reference numeral comprising of an array of two digits wherein the first digit represents the welding sequence number in increasing numerical order starting with "1" and in increasing numerical order up to the number determined by the number of sides of the multi-sided polyhedron-shaped disposable container, and the second digit represents the film lap weld group III designated by the number "3".

As can be seen with the exemplary embodiment disposable containers, ports may be formed in the center of the panels without running the risk of being intercepted by weld seams.

What is claimed is:

1. A polyhedron container formed from flexible weldable plastic film comprising:

a polygonal first end comprising a plurality of edges;

a polygonal second end opposite the first end comprising a plurality of edges, wherein the polygonal second end has the same number of edges as the polygonal first end;

a plurality of sides extending between the polygonal first and second ends, wherein said plurality of sides are equal in number to the number of edges of each of the first and second polygonal ends, wherein each of said plurality of sides extend between an edge of the polygonal first end and an edge of the polygonal second end, wherein said plurality of sides define the sides of the polyhedron container and said first and second polygonal ends define opposite ends of the container, wherein each side is connected on opposite edges thereof to two adjacent sides along a first weld line and a second weld line, respectively, wherein each side comprises a third weld line extending between the first weld line and the second weld line;

an opening formed through a center of the first polygonal end; and an opening formed on at least one of said sides at a location midway between the first and second weld lines of said side.

2. A container as recited in claim 1, wherein each side is welded on opposite edges thereof to two adjacent sides along the first weld line and the second weld line, respectively.

3. A container as recited in claim 1, wherein said container is disposable.

4. A container as recited in claim 1, wherein the third weld line of each side is not aligned with the third weld line of an adjacent side.

5. A container as recited in claim 4, further comprising another opening formed Through the center of the second polygonal end.

6. A container as recited in claim 5, further comprising a port connected to each Opening.

7. A container as recited in claim 6, further comprising a port welded to each opening.

8. A polyhedron container formed from flexible weldable plastic film comprising:

a polygonal first end comprising a plurality of edges;

a polygonal second end opposite the first end comprising a plurality edges, wherein the polygonal second end has the same number of edges as the first polygonal end;

a plurality of generally trapezoidal first sides, wherein a trapezoidal first side extends from an edge of the polygonal second end, wherein an edge of the polygonal second end defines a first edge of a trapezoidal first side, wherein each trapezoidal first side comprises a second edge opposite the first edge, said second edge being longer than said first edge, wherein each trapezoidal first side comprises a third edge extending between the first and second edges and a fourth edge extending between the first and second edges, wherein each trapezoidal first side third edge is connected to an adjacent trapezoidal first side fourth edge along a first weld line;

a plurality of second sides, wherein said plurality of second sides are equal in number to the number of edges in each of the polygonal first and second ends, wherein each of said plurality of second sides extends between an edge of the polygonal first end and a second edge of a trapezoidal first side, whereby said plurality of second sides define the sides of the polyhedron container, wherein said trapezoidal first sides define a projection extending from said container sides and said first and second polygonal ends define opposite ends of the container, wherein each side is connected on opposite edges thereof to two adjacent sides along a second weld line and a third weld line, respectively, wherein each side comprises a fourth weld line extending between the second weld line and the third weld line; and an opening formed though a center of the first polygonal end; and an opening formed on at least one of said sides at a location midway between the first and second weld lines of said side.

9. A container as recited in claim 8, wherein each side is welded on opposite edges thereof to two adjacent sides along the second weld line and the third weld line, respectively.

10. A container as recited in claim 8, wherein said container is disposable.

11. A container as recited in claim 8, wherein each trapezoidal first side third edge is welded to an adjacent trapezoidal first side fourth edge along a first weld line.

12. A container as recited in claim 11, wherein each side is welded on opposite edges thereof to two adjacent sides along the second weld line and the third weld line, respectively.

13. A container as recited in claim 8, wherein the fourth weld line of each side is not aligned with the fourth weld line of either of its adjacent sides.

14. A container as recited in claim 13, further comprising another opening formed through the center of the second polygonal end.

15. A container as recited in claim 14, further comprising a port connected to each opening.

16. A container as recited in claim 14, further comprising a port welded to each opening.

* * * * *

UNITED STATES PATENT AND TRADEMARK OFFICE

CERTIFICATE OF CORRECTION

PATENT NO. : 8,777,047 B2
APPLICATION NO. : 14/032057
DATED : July 15, 2014
INVENTOR(S) : Max Blomberg It is certified that error appears in the above-identified patent and that said Letters Patent is hereby corrected as shown below:

In the Claims

| | |
|---|---|
| Col. 16, line 10, Claim 5 | Delete "formed Through", |
| | Insert --formed through-- |
| Col. 16, line 13, Claim 6 | Delete "each Opening.", |
| | Insert --each opening.-- |
| Col. 16, line 14, Claim 7 | Delete "claim 6", |
| | Insert --claim 5-- |
| Col. 16, line 20, Claim 8 | Delete "plurality edges,", |
| | Insert --plurality of edges,-- |

Signed and Sealed this
Fourteenth Day of June, 2016

Michelle K. Lee

Michelle K. Lee
*Director of the United States Patent and Trademark Office*